US010612287B2

(12) United States Patent
Her

(10) Patent No.: US 10,612,287 B2
(45) Date of Patent: Apr. 7, 2020

(54) FOLDING APPARATUS FOR A FOLDING DOOR WITH THREE SIDES

(71) Applicant: Ju Beum Her, Gwangju-si (KR)

(72) Inventor: Ju Beum Her, Gwangju-si (KR)

( * ) Notice: Subject to any disclaimer, the term of this patent is extended or adjusted under 35 U.S.C. 154(b) by 114 days.

(21) Appl. No.: 15/833,550

(22) Filed: Dec. 6, 2017

(65) Prior Publication Data

US 2018/0163448 A1 Jun. 14, 2018

(51) Int. Cl.

| | |
|---|---|
| ***E05D 15/26*** | (2006.01) |
| ***E05D 15/06*** | (2006.01) |
| ***E06B 3/50*** | (2006.01) |
| ***E05D 13/00*** | (2006.01) |
| ***E05D 15/00*** | (2006.01) |
| ***E05D 15/58*** | (2006.01) |
| *E06B 3/48* | (2006.01) |

(52) U.S. Cl.

CPC ..... *E05D 15/26* (2013.01); *E05D 13/00* (2013.01); *E05D 15/00* (2013.01); *E05D 15/06* (2013.01); *E05D 15/063* (2013.01); *E05D 15/0604* (2013.01); *E05D 15/58* (2013.01); *E06B 3/50* (2013.01); *E05Y 2201/62* (2013.01); *E05Y 2201/654* (2013.01); *E05Y 2900/132* (2013.01); *E06B 3/481* (2013.01)

(58) Field of Classification Search

CPC ..... E05D 15/26; E05D 15/063; E05D 15/58; E06B 3/50; E06B 3/481

See application file for complete search history.

(56) References Cited

U.S. PATENT DOCUMENTS 1,008,989 A * 11/1911 Prouty ..... E05D 15/063 16/196
2005/0022949 A1* 2/2005 Lee ..... E05D 3/12 160/199

FOREIGN PATENT DOCUMENTS

FR 2353701 A1 * 12/1977 ..... E05D 15/26
KR 10-2012-0025296 * 3/2012
KR 10-1153687 B1 6/2012

* cited by examiner

*Primary Examiner* — Gregory J Strimbu
(74) *Attorney, Agent, or Firm* — Novick, Kim & Lee, PLLC; Jae Youn Kim

(57) ABSTRACT

A folding apparatus for a folding door can be folded or unfolded and moved to the inside as well as to the outside when the folding door is folded. The folding apparatus includes a first upper moving part, a first lower moving part, a second upper moving part, a second lower moving part, a first rotating pulley, a second rotating pulley, a third rotating pulley, a fourth rotating pulley, a fifth rotating pulley, and a sixth rotating pulley, wherein the second upper moving part and the second lower moving part move together right and left by an equal interval by first and second wires.

3 Claims, 6 Drawing Sheets

FOLDING APPARATUS FOR A FOLDING DOOR WITH THREE SIDES

CROSS REFERENCE TO RELATED APPLICATION

The present application claims priority to Korean Patent Application No. 10-2016-0168821, filed Dec. 12, 2016, the entire contents of which is incorporated herein for all purposes by this reference.

BACKGROUND OF THE INVENTION

Field of the Invention

The present invention relates generally to a folding apparatus having a three sided structure for a folding door. More particularly, the present invention relates to a folding apparatus having a three sided structure for a folding door, which is folded or unfolded like a folding screen and is configured to be easily moved to the inside as well as to the outside when the folding door is folded.

Description of the Related Art

In general, a folding door is a door that is folded and unfolded like a folding screen by connecting a plurality of doors. The folding door has recently been applied to a partition that divides a balcony or an interior wall into several spaces, and glass may be applied to the folding door for lighting or indoor viewing.

The folding door is configured such that a plurality of individual doors is hinged to be folded and unfolded, wherein rollers are fixedly provided on the upper and lower sides of the individual doors, and a guide rail on which rollers of the individual doors are installed is provided at the top and bottom of a door frame where the folding door is installed. Thereby, the plurality of individual doors slides in the guide rail of the door frame by the rollers and moves to one side, thus is folded or unfolded sequentially, and accordingly opens and closes the space where the folding door is installed.

As described above, after the space where the folding door is installed is opened by folding the folding door, the folded folding door is completely folded and accommodated inside of the room or folded to protrude to the outside according to the installation structure. When the folding door is configured to be completely folded and accommodated only toward the indoor or outdoor side, there was a problem in that it is necessary to reconstruct the folding door in the case of changing the direction of accommodation/protruding due to the change of the use purpose of the indoor space or the outdoor space.

Further, since the folding door is configured to be completely folded and accommodated only toward the indoor or outdoor side, it is impossible to change the folding state of the folding door, that is, folding it diagonally or folding it by varying the accommodation/protruding length of the indoor side or the outdoor side, or both indoor and outdoor sides depending on the circumstances of the surrounding environment in which the folding door is installed.

The foregoing is intended merely to aid in the understanding of the background of the present invention, and is not intended to mean that the present invention falls within the purview of the related art that is already known to those skilled in the art.

Documents of Related Art (Patent Document 1) Korean Patent No. 10-1153687.

SUMMARY OF THE INVENTION

Accordingly, the present invention has been made keeping in mind the above problems occurring in the related art, and an object of the present invention is to provide a folding apparatus having a three sided structure for a folding door, which is capable of protruding in both indoor and outdoor directions.

Another object of the present invention is to provide a folding apparatus having a three sided structure for a folding door, which is capable of always maintaining the horizontal state when the folding door is moved.

A further object of the present invention is to provide a folding apparatus having a three sided structure for a folding door, which has a simple structure with the same effect as above, whereby manufacturability is improved, and materials cost is reduced.

In order to achieve the above object, according to one aspect of the present invention, there is provided a folding apparatus having a three sided structure for a folding door, the apparatus including a first upper moving means, a first lower moving means, a second upper moving means, a second lower moving means, a first rotating pulley, a second rotating pulley, a third rotating pulley, a fourth rotating pulley, a fifth rotating pulley, and a sixth rotating pulley, wherein a first end of a first wire is coupled to the second side of the second upper moving means, and a second end thereof is coupled to the first side of the second lower moving means through the first rotating pulley via the sixth rotating pulley and through the fifth rotating pulley, a first end of a second wire is coupled to the first side of the second upper moving means, and a second end thereof is coupled to the second side of the second lower moving means through the second rotating pulley via the third rotating pulley and through the fourth rotating pulley, and the second upper moving means and the second lower moving means move together right and left by an equal interval.

Further, the first upper moving means and the second upper moving means may be connected to a turning member, and the first lower moving means and the second lower moving means may be connected to a turning member.

Further, the turning member may includes: a first turning member provided with a first angle adjustment protrusion; a second turning member provided with a second angle adjustment protrusion; and a rotation guide pin guiding rotations of the first turning member and the second turning member, wherein the first angle adjustment protrusion and the second angle adjustment protrusion are brought into contact with each other at ends thereof while rotating, thereby adjusting a rotation angle.

Further, a rotation angle of the turning member may be 90 degrees.

According to the present invention, since the folding apparatus is provided only on three sides, that is, one side of right and left sides of the folding door, an upper side, and a lower side, manufacturability is improved, and materials cost is reduced compared to a conventional structure.

Further, since the second upper moving means and the second lower moving means move in right and left directions at equal intervals, it is possible to always maintain the horizontal state when the folding door is moved.

Further, since the turning member is provided, it is possible to rotate the folding door by a desired angle.

Further, since the folding door is prevented from leaning or tilting to one side by setting the rotation angle to 90 degrees, it is possible to solve the inconvenience when folding and unfolding of the folding door, and is possible to improve the stability of the folding door.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
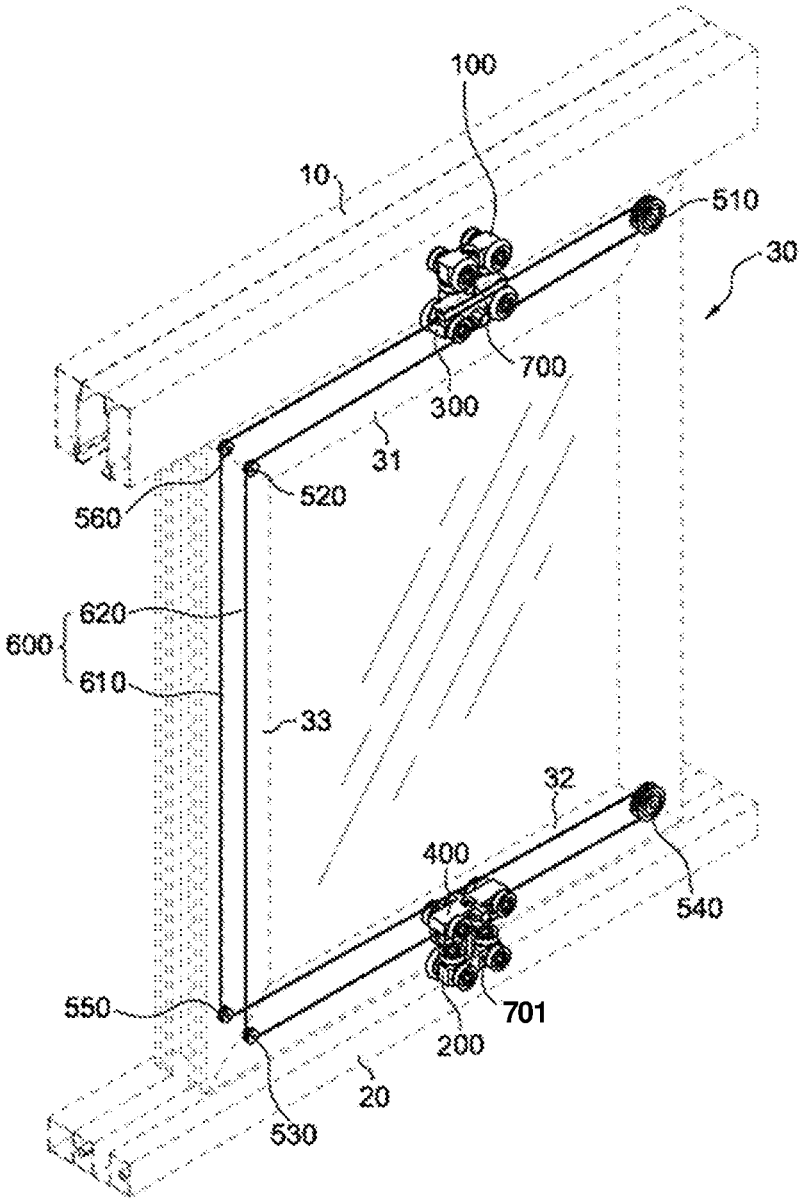
FIG. 1 is a view conceptually showing a technology configuration of a folding door according to an embodiment of the present invention.

In the following description, the structural or functional description specified to exemplary embodiments according to the concept of the present invention is intended to describe the exemplary embodiments, so it should be understood that the present invention may be variously embodied, without being limited to the exemplary embodiments.

The exemplary embodiments according to the concept of the present invention may be variously modified and may have various shapes, so examples of which are illustrated in the accompanying drawings and will be described in detail with reference to the accompanying drawings. However, it should be understood that the exemplary embodiments according to the concept of the present invention are not limited to the embodiments which will be described hereinbelow with reference to the accompanying drawings, but various modifications, equivalents, additions and substitutions are possible, without departing from the scope and spirit of the invention. Wherever possible, the same reference numerals will be used throughout the drawings and the description to refer to the same or like parts.

It will be understood that, although the terms first, second, etc. may be used herein to describe various elements, these elements should not be limited by these terms.

These terms are only used to distinguish one element, from another element. For instance, a first element discussed below could be termed a second element without departing from the teachings of the present invention. Similarly, the second element could also be termed the first element.

It will be understood that when an element is referred to as being "coupled" or "connected" to another element, it can be directly coupled or connected to the other element or intervening elements may be present therebetween. In contrast, it should be understood that when an element is referred to as being "directly coupled" or "directly connected" to another element, there are no intervening elements present. Further, the terms used herein to describe a relationship between elements, for example, "between", "directly between", "adjacent", or "directly adjacent" should be interpreted in the same manner as those described above.

The terminology used herein is for the purpose of describing particular embodiments only and is not intended to be limiting. As used herein, the singular forms "a," "an", and "the" are intended to include the plural forms as well, unless the context clearly indicates otherwise. It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof.

Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinbelow, exemplary embodiments of the present invention will be described in detail with reference to the accompanying drawings.

Figure 2:
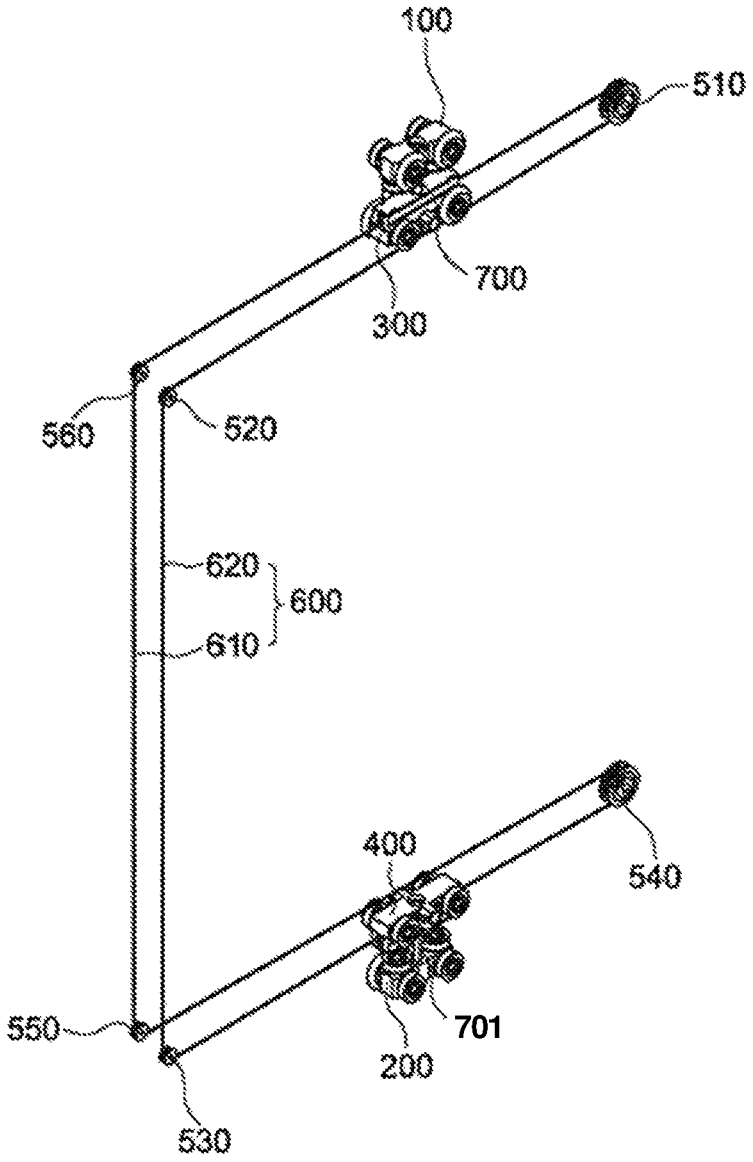
FIG. 2 is a conceptual perspective view showing a folding apparatus having a three sided structure for a folding door according to an embodiment of the present invention.
Figure 3:
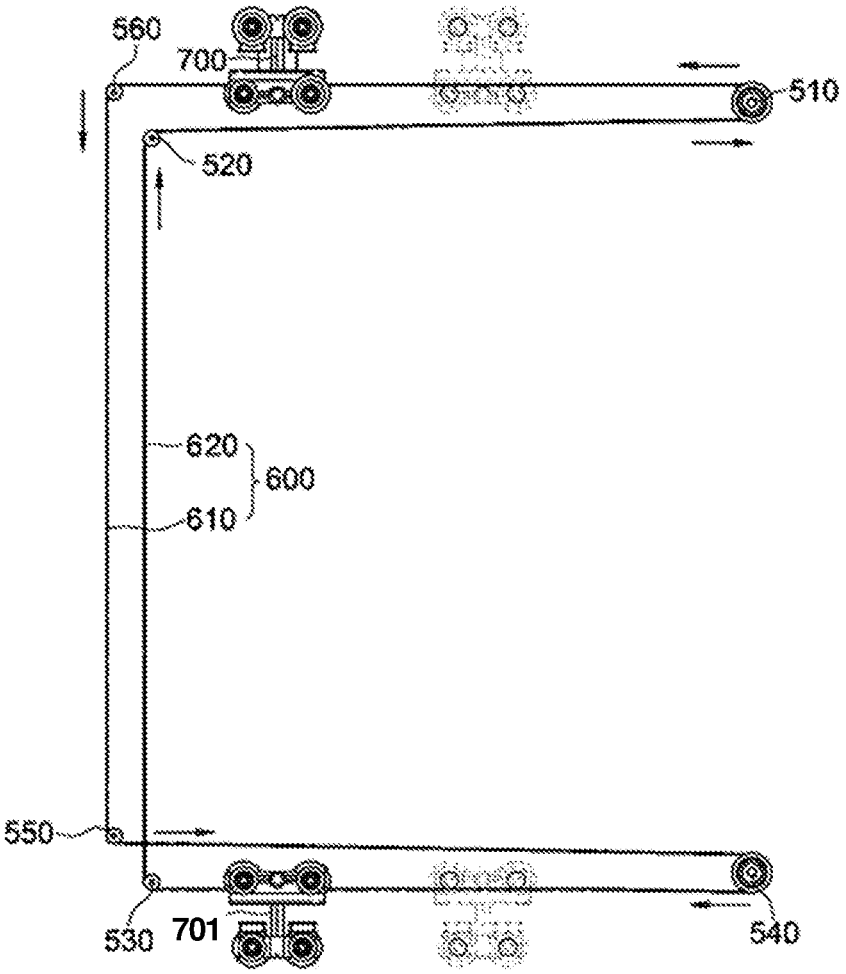
FIGS. 3 and 4 are views showing a state where the folding apparatus having a three sided structure for a folding door according to an embodiment of the present invention moves right and left.
Figure 4:
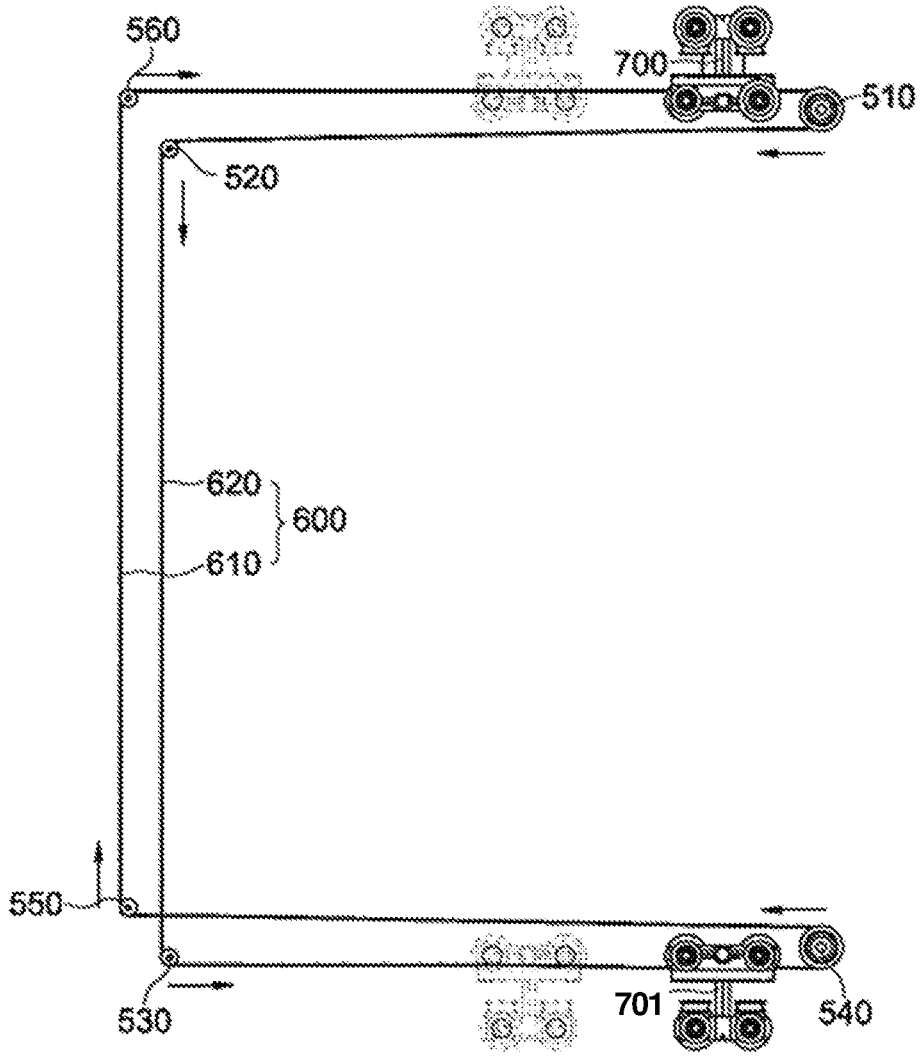

FIG. 1 is a view conceptually showing a technology configuration of a folding door according to an embodiment of the present invention; FIG. 2 is a conceptual perspective view showing a folding apparatus having a three sided structure for a folding door according to an embodiment of the present invention; and FIGS. 3 and 4 are views showing a state where the folding apparatus having a three sided structure for a folding door according to an embodiment of the present invention moves right and left.

A folding apparatus having a three sided structure for a folding door of the present invention will be described as follows with reference to FIGS. 1 to 4.

The folding apparatus having a three sided structure for a folding door of the present invention includes a first upper moving means 100, a first lower moving means 200, a second upper moving means 300, a second lower moving means 400, a first rotating pulley 510, a second rotating pulley 520, a third rotating pulley 530, a fourth rotating pulley 540, a fifth rotating pulley 550, and a sixth rotating pulley 560.

Firstly, the first upper moving means 100 is provided in an upper guide frame 10 supporting an upper portion of a folding door 30, and moves right and left along an inner surface of the upper guide frame 10.

The first lower moving means 200 is provided in a lower guide frame 20 supporting a lower portion of the folding door 30, and moves right and left along an inner surface of the lower guide frame 20.

The first upper moving means 100 and the first lower moving means 200 are provided with a plurality of moving means (reference numeral not given) respectively, and the upper guide frame 10 and the lower guide frame 20 are provided with moving lines (reference numeral not given) corresponding to the moving means such that the moving means move along the moving lines.

The second upper moving means 300 is provided in an upper frame 31 of the folding door 30, and is connected with the first upper moving means 100 via a first rotating member 700.

The configuration of the rotating member can be found in Korean Patent No. 10-1153687 filed by the applicant of the present invention, and a 'Free folding door' in this field can be used in the construction of the rotating member.

The second lower moving means 400 is provided in a lower frame 32 of the folding door 30, and is connected with the first lower moving means 200 via a second rotating member 701.

The second upper moving means 300 and the second lower moving means 400 are also provided with a plurality of moving means, and the upper frame 31 and the lower frame 32 are also provided with moving lines corresponding to the moving means such that the moving means move in the right and left directions along inner surfaces of the upper frame 31 and the lower frame 32 along the moving lines.

The first rotating pulley 510 is provided at a first side of the second upper moving means 300 and disposed in the upper frame 31.

The second rotating pulley 520 is provided at a second side of the second upper moving means 300 and disposed in the upper frame 31.

The third rotating pulley 530 is provided at a second side of the second lower moving means 400 and disposed in the lower frame 32.

The fourth rotating pulley 540 is provided at a first side of the second lower moving means 400 and disposed in the lower frame 32.

The fifth rotating pulley 550 is provided at the second side of the second lower moving means 400 while being spaced apart from the third rotating pulley 530 at a different height therefrom, and disposed in the lower frame 32.

The sixth rotating pulley 560 is provided at the second side of the first upper moving means 100 while being spaced apart from the second rotating pulley 520 at a different height therefrom, and disposed in the upper frame 31.

Meanwhile, the rotating pulleys are rotatably connected by a wire being wound therearound, and various modifications are possible within the known art as long as the shape and structure are capable of being wound and rotated.

In the configured state as described above, a first end of a first wire 610 is coupled to the second side of the second upper moving means 300, and a second end thereof is coupled to the first side of the second lower moving means 400 through the sixth rotating pulley 560 and through the fifth rotating pulley 550.

Further, a first end of a second wire 620 is coupled to the first side of the second upper moving means 300, and a second end thereof is coupled to the second side of the second lower moving means 400 through the first rotating pulley, the second rotating pulley 520, and the third rotating pulley 530.

Coupled as described above while maintaining a predetermined tension, as shown in FIGS. 3 and 4, the second upper moving means 300 and the second lower moving means 400 move together right and left by an equal interval to be parallel with each other.

The present invention is configured such that a wire 600 is provided only on three sides of a frame, that is, one side frame 33 (first side), an upper frame 31 (second side), and a lower frame 32 (third side), which is advantageous in that the configuration is simple, manufacturability is improved, and materials cost is reduced compared to a conventional four-side structure.

Meanwhile, in the above structure, the first upper moving means 100 and the first lower moving means 200, and the second upper moving means 300 and the second lower moving means 400 may be connected to turning members 800 instead of the rotating members 700, 701.

Figure 5:
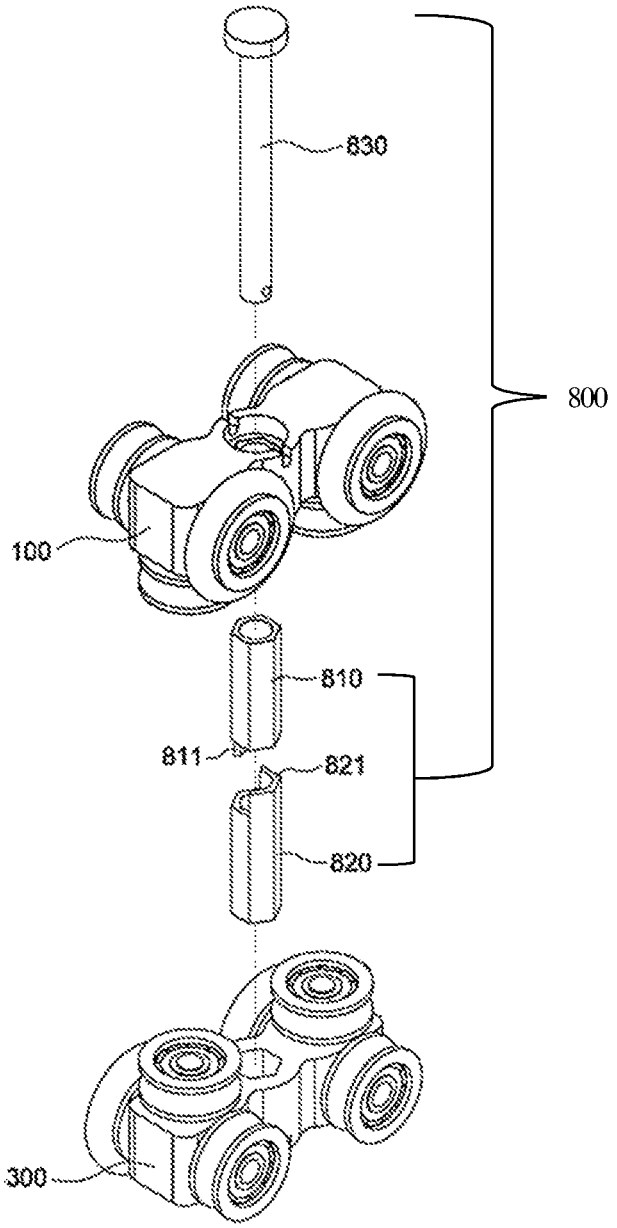
FIG. 5 is a view showing a turning member of the folding apparatus having a three sided structure for a folding according to an embodiment of the present invention.
Figure 6:
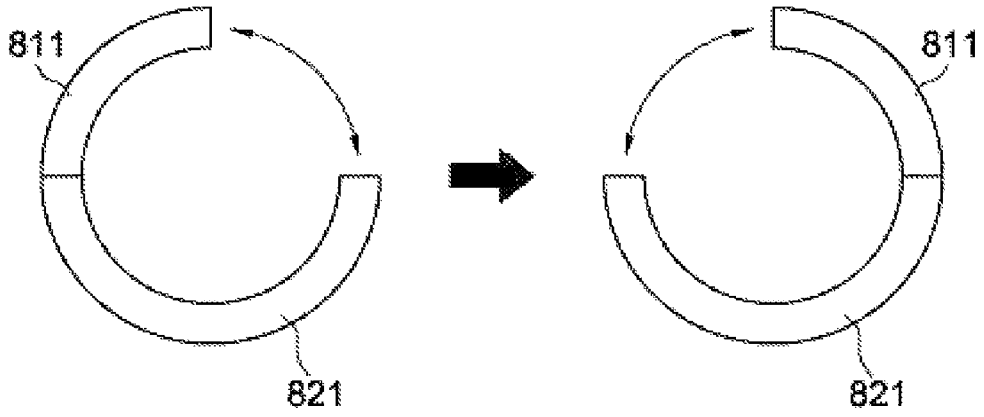
FIG. 6 is a conceptual view showing the principle of rotation of the turning member shown in FIG. 5.

FIG. 5 is a view showing the turning member 800 of the folding apparatus having a three sided structure for a folding door according to an embodiment of the present invention; and FIG. 6 is a conceptual view showing the principle of rotation of the turning member 800 shown in FIG. 5. For convenience, the turning member 800 in FIG. 5 is shown to illustrate the connection between the turning member 800 and the first upper moving means 100 and the second upper moving means 300. However, one of ordinary skill in the art can readily determine based on the present disclosure that the turning member 800 may be connected to the first lower moving means 200 and the second lower moving means 400 in substantially the same manner.

The turning member 800 according to the present invention will be described as follows with reference to FIGS. 5 and 6.

Firstly, FIG. 5 shows the turning member 800 coupled to the first upper moving means 100 and the second upper moving means 300, and a shape and a structure of a turning member 800 coupled to the first lower moving means 200 and the second lower moving means 400 are shown in FIG. 5.

The turning member 800 includes a first turning member 810, a second turning member 820, and a rotation guide pin 830.

The first turning member 810 is configured such that an annular first coupling hole (reference numeral not given) is formed through a center of the first turning member 810 in a longitudinal direction of the first turning member 810, and a first end thereof is coupled to the first upper moving means 100.

As shown in the drawing, it is preferred that the outer shape of the first turning member 810 be in an angular shape to prevent rotation, and the second end of the first turning member 810 is formed with a first angle adjustment protrusion 811.

The first angle adjustment protrusion 811 is configured such that a predetermined width of a second end thereof protrudes in a longitudinal direction to prevent interference with the first coupling hole.

The second turning member 820 is configured such that an annular second coupling hole (reference numeral not given), which corresponds to the first coupling hole in a longitudinal direction, is formed through a center of the second turning member 820, and a first end thereof is coupled to the second upper moving means 300.

It is preferred that the outer shape of the second turning member 820 be in an angular shape to prevent rotation as in the first turning member 810, and the second end of the second turning member 820 is formed with a second angle adjustment protrusion 821.

The second angle adjustment protrusion 821 is configured such that a predetermined width of a second end thereof protrudes in a longitudinal direction to prevent interference with the second coupling hole.

The rotation guide pin 830 is shafted into the first coupling hole and the second coupling hole to guide rotations of the first turning member 810 and the second turning member 820, which is also associated with the folding operation of folding door 30.

Here, the first angle adjustment protrusion 811 and the second angle adjustment protrusion 821 are supported by the rotation guide pin 830, and as shown in FIG. 6, they are brought into contact with each other at ends thereof, thereby adjusting the rotation angle.

FIG. 6 conceptually illustrates a structure that is rotated at an angle of 90 degrees, and various shapes, lengths, and positions of the first angle adjustment protrusion 811 and the second angle adjustment protrusion 821 may be possible as long as they are rotated at an angle of 90 degrees.

The rotation angle can be designed to an angle required by a user when designing, and as shown in the drawing, when the rotation angle is designed to be 90 degrees, the stability can be improved compared to the free folding door. In particular, it is possible to increase ease of use by preventing the folded folding door 30 from leaning or tilting to one side.

Meanwhile, the folding operation of the folding door 30 according to the present invention and a state in which the folded folding door 30 is positioned inwards and outwards can be referred to the specification and drawings of Korean Patent No. 10-1153687 filed by the applicant of the present invention.

What is claimed is:

1. A folding apparatus for a folding door, the folding apparatus comprising:

a first upper moving part provided in an upper guide frame, wherein the upper guide frame supports an upper frame of the folding door;

a first lower moving part provided in a lower guide frame, wherein the lower guide frame supports a lower frame of the folding door;

a second upper moving part connected with the first upper moving part via a first turning member and provided in the upper frame of the folding door to move along an inner surface of the upper frame of the folding door;

a second lower moving part connected with the first lower moving part via a second turning member and provided in the lower frame of the folding door to move along an inner surface of the lower frame of the folding door; and a pulley system disposed in the upper frame of the folding door, the lower frame of the folding door, and a side frame of the folding door and comprising a plurality of rotating pulleys, a first wire, and a second wire, wherein the plurality of rotating pulleys comprises:

a first rotating pulley provided in the upper frame of the folding door, and disposed on a first side of the second upper moving part;

a second rotating pulley provided in the upper frame of the folding door, and disposed on a second side of the second upper moving part;

a third rotating pulley provided in the lower frame of the folding door, and disposed on a first side of the second lower moving part;

a fourth rotating pulley provided in the lower frame of the folding door, and disposed on a second side of the second lower moving part;

a fifth rotating pulley provided in the lower frame of the folding door, and disposed on the first side of the second lower moving part while being spaced apart from the third rotating pulley at a different height therefrom; and a sixth rotating pulley provided in the upper frame of the folding door, and disposed on the second side of the second upper moving part while being spaced apart from the second rotating pulley at a different height therefrom, wherein a first end of the first wire is mounted on the second upper moving part on the second side of the second upper moving part, and a second end of the first wire is mounted on the second lower moving part on the second side of the second lower moving part, wherein a first end of the second wire is mounted on the second upper moving part on the first side of the second upper moving part, and a second end of the second wire is mounted on the second lower moving part on the first side of the second lower moving part, and wherein the first turning member comprises:

a first turning member part having a first coupling hole formed through a center thereof, wherein a first end of the first turning member part is coupled to the first upper moving part and a second end of the first turning member part includes a first angle adjustment protrusion;

a second turning member part having a second coupling hole formed through a center thereof, wherein a first end of the second turning member part is coupled to the second upper moving part and a second end of the second turning member part includes a second angle adjustment protrusion corresponding to the first angle adjustment protrusion; and a rotation guide pin inserted into the first coupling hole and the second coupling hole to rotatably connect the first turning member part and the second turning member part, wherein the first angle adjustment protrusion and the second angle adjustment protrusion are configured to rotatably contact each other thereby defining a rotation angle of the folding door, and wherein the first wire and the second wire of the pulley system traverse along the upper frame of the folding door, the lower frame of the folding door, and the side frame of the folding door, the folding door is configured to move in right and left directions with respect to the second upper moving part and the second lower moving part along the upper and lower guide frames, and the second upper moving part and the second lower moving part remain apart while the folding door moves.

2. The folding apparatus of claim 1, wherein the rotation angle is 90 degrees.

3. The folding apparatus of claim 1, wherein the first wire is coupled to the sixth rotating pulley, the fifth rotating pulley, and the fourth rotating pulley, and wherein the second wire is coupled to the first rotating pulley, the second rotating pulley, and the third rotating pulley.

* * * * *